US009493284B2

(12) United States Patent
Tsuruta et al.

(10) Patent No.: US 9,493,284 B2
(45) Date of Patent: Nov. 15, 2016

(54) CAPPED SPOUT

(71) Applicant: ORIHIRO ENGINEERING CO., LTD., Tomioka-shi (JP)

(72) Inventors: Orihiro Tsuruta, Takasaki (JP); Shinji Ooka, Hiratsuka (JP); Naoyuki Abe, Hiratsuka (JP)

(73) Assignee: ORIHIRO ENGINEERING CO., LTD., Tomioka-Shi, Gunma (JP)

( * ) Notice: Subject to any disclaimer, the term of this patent is extended or adjusted under 35 U.S.C. 154(b) by 11 days.

(21) Appl. No.: 14/435,075

(22) PCT Filed: Sep. 13, 2013

(86) PCT No.: PCT/JP2013/074796

§ 371 (c)(1),
(2) Date: Apr. 10, 2015

(87) PCT Pub. No.: WO2014/057767

PCT Pub. Date: Apr. 17, 2014

(65) Prior Publication Data

US 2015/0274391 A1 Oct. 1, 2015

(30) Foreign Application Priority Data

Oct. 12, 2012 (JP) ..... 2012-226876

(51) Int. Cl.
*B65D 51/22* (2006.01)
*B65D 75/58* (2006.01)
(Continued)

(52) U.S. Cl.
CPC ..... *B65D 75/5872* (2013.01); *B65D 33/16* (2013.01); *B65D 47/10* (2013.01); *B65D 75/5883* (2013.01); *B65D 2251/0015* (2013.01); *B65D 2251/0093* (2013.01)

(58) Field of Classification Search
CPC ... B65D 17/161; B65D 47/36; B65D 51/222
USPC ..... 222/107, 105, 95, 541.1–541.9, 80–90, 222/153, 153.06
See application file for complete search history.

(56) References Cited

U.S. PATENT DOCUMENTS 3,029,987 A * 4/1962 Gronemeyer ..... B05C 17/005 220/89.2
3,643,833 A * 2/1972 Fraze ..... B65D 17/163 220/270

(Continued)

FOREIGN PATENT DOCUMENTS

JP 2004-067184 A 3/2004
JP 2007-161254 A 6/2007

(Continued)

*Primary Examiner* — Paul R Durand
*Assistant Examiner* — Charles P Cheyney
(74) *Attorney, Agent, or Firm* — Knobbe Martens Olson & Bear LLP

(57) ABSTRACT

A capped spout of the present invention has a spout (1) and a cap (30) that engages with the spout. Spout (1) has a cylindrical body (3) and a welding part (4). Cylindrical body (2) has an interior that serves as a discharge passage (2) for discharging liquid content in a bag-shaped package, wherein the cap (30) is attached to the cylindrical body (2) in order to close an opening of an outlet end of the discharge passage. The welding part (4) is formed outside the cylindrical body (3) and is welded to an opening of the package. The capped spout of the present invention further has a thin film part (11) that is formed inside the cylindrical body (2) in order to close an opening of an inlet end of the discharge passage. Thin film part (11) has a first surface that faces an interior of the cylindrical body, the interior being closed by the cap (30) and the thin film part (11). A circular groove (12) that is concentric with the thin film part is formed on the first surface. The circular groove (12) is formed of an arc-shaped first groove (12*a*) and an arc-shaped second groove (12*b*) that is longer than the first groove (12*a*). Third linear grooves (13*a*, 13*b*) extend on the first surface outwardly from each of both ends of the second groove (12*b*) in a radial direction of the cylindrical body (2). The first groove (12*a*) is unbreakable and the second (12*b*) and third grooves (13*a*, 13*b*) are breakable. An arc-shaped fourth groove (14) is further formed on the first surface, wherein the fourth groove is located radially outward of the first groove (12*a*) between a pair of the third grooves (13*a*, 13*b*). The fourth groove (14) is unbreakable.

5 Claims, 4 Drawing Sheets

(51) Int. Cl.
*B65D 33/16* (2006.01)
*B65D 47/10* (2006.01)

(56) References Cited

U.S. PATENT DOCUMENTS 4,709,835 A * 12/1987 Kruger ..... B67D 3/0003 222/541.6
5,505,235 A * 4/1996 Gorokhovsky ..... B65D 47/36 141/319
5,642,838 A * 7/1997 Stoody ..... B05B 11/0043 222/105
6,206,222 B1 * 3/2001 Cudzik ..... B65D 1/165 220/258.3
7,850,044 B2 * 12/2010 Hildebrand ..... B65D 75/5883 220/604
8,844,761 B2 * 9/2014 Zabaleta ..... B65D 41/32 220/254.8

FOREIGN PATENT DOCUMENTS

JP 2008-087786 A 4/2008
JP 2009-166898 A 7/2009
JP 2010-120658 A 6/2010

* cited by examiner

CAPPED SPOUT

CROSS-REFERENCE TO RELATED APPLICATIONS

This application is the U.S. National Phase under 35. U.S.C. §371 of International Application PCT/JP2013/074796, filed Sep. 13, 2013, which claims priority to Japanese Patent Application No. 2012-226876, filed Oct. 12, 2012. The disclosures of the above-described applications are hereby incorporated by reference in their entirety.

TECHNICAL FIELD

The present invention relates to a spout used by being welded to a package that holds content, such as beverage. The present invention relates, in particular, to a capped spout from which the chemical agent is removed, wherein the chemical agent adheres to the spout during the sterilization process that is performed before the package is filled with the content.

BACKGROUND ART

Spouts have been widely used for bag-shaped packages that hold a fluid or jelly content due to ease of resealing the package and discharging the content because the package is formed of a plastic film, a lamination of the plastic film and a metal foil or the like and because such a resin spout is attached to the package by welding.

In a bag-shaped package that holds food or beverage, cleanliness is generally ensured by filling the package with content that has been heated at a high temperature.

However, heating at a high temperature may spoil the taste depending on the contents. In addition, productivity is reduced due to the need to carry out a cooling process after the processes for heating the content and filling the package have been completed. Thus, the content is preferably filled in a previously sterilized package using an aseptic process (this is called "aseptic filling"). Bag-shaped packages having welded spouts are also required to be accommodated to aseptic filling.

In aseptic processing, a capped spout that is previously sterilized by electron beam radiation is connected to a package and is further sterilized by a chemical agent. It is therefore important that the chemical agent not adhere to the spout of the manufactured bag-shaped package. It is especially important that the chemical agent that has entered a discharge pipe or minute asperities of the spout not remain in the pipe or the asperities. In other words, any chemical agent that adheres must be completely removed because a chemical agent that remains in the spout or in the cap causes problems such as degradation of the taste of the content.

However, it is difficult to completely remove the chemical agent that remains at these portions by simple processes, such as blowing away with air. On the other hand, complicated removing processes, such as heating and drying, do not lead to satisfactory results with regard to productivity and cost. Accordingly, in order to ensure that no chemical agent remains, it is preferable, at the sterilization process that uses the chemical agent, to prevent any chemical agent from enter portions of a spout from which removing them is difficult.

As known from, for example, JP2008-87786A (Patent Document 1) and JP2009-166898A (Patent Document 2), there are spouts that have a discharge pipe with an opening that has been previously closed.

Patent Document 1 proposes a spout that includes a discharge pipe and an attachment that is attached to an opening of the container body. The spout has a diaphragm that is arranged in the discharge pipe and that closes a discharge port, and a multi-layered sleeve that is arranged on the inner surface of the discharge pipe. The diaphragm and the lower end of the sleeve are disposed at a location where a seal is formed against the container body.

Patent Document 2 proposes a spout (1) including a discharge pipe (3) and an attachment (6) that is welded to the inner edge of a pouch (2). A sealed bottom (5) and a tear-out piece (9) are provided at the lower end of the discharge pipe (3). A breakable weakened part (8) is formed in the discharge pipe that is located above the sealed bottom (5).

Both Patent Documents 1 and 2 mentioned above disclose a spout that allows content to be discharged by breaking the diaphragm or by removing the tear-out piece when the spout is used.

However, in the spout configured as shown in Patent Documents 1 and 2 mentioned above, the diaphragm or the tear-out piece separates from the spout and floats in the package, and there is some concern that purchasers of the food or the beverage may accidentally swallow them. Even though such an occurrence is remote, the concern above is not preferable from the standpoint of the purchaser's mental well-being.

Further, the separated diaphragm or tear-out piece may move with the flow of the content to obstruct the flow path of the spout again and may prevent the content from being discharged. This may also happen in the case where the diaphragm and the tear-out piece are not completely separated from the discharge pipe.

PRIOR ART DOCUMENTS

Patent Document

Patent Document 1: JP2008-87786A
Patent Document 2: JP2009-166898A

SUMMARY OF THE INVENTION

The object of the present invention is to provide a spout that can solve the problem in Background Art described above. One example of the object is to prevent a chemical agent from entering the spout, to effectively prevent the chemical agent from remaining in the spout when the spout is sterilized by the chemical agent. In addition, the object is to perform aseptic processing without hampering discharge of the content.

A capped spout of the present invention has a spout and a cap that engages with the spout. The spout has a cylindrical body and a welding part. The interior of the cylindrical body serves as a discharge passage for discharging liquid content in a bag-shaped package, wherein the cap is attached to the cylindrical body in order to close the opening of the outlet end of the discharge passage. The welding part is formed outside the cylindrical body and is welded to an opening of the package.

The capped spout of the present invention further has a thin film part that is formed inside the cylindrical body in order to close the opening of the inlet end of the discharge passage. The thin film part has a first surface that faces an interior of the cylindrical body, the interior being closed by the cap and the thin film part. A circular groove that is concentric with the thin film part is formed on the first surface. The circular groove is formed of an arc-shaped first groove and an arc-shaped second groove that is longer than the first groove. Third linear grooves extend on the first surface outwardly from each of both ends of the second groove in the radial direction of the cylindrical body. The first groove is unbreakable and the second and third grooves are breakable. An arc-shaped fourth groove is further formed on the first surface, wherein the fourth groove is located radially outward of the first groove between a pair of the third grooves. The fourth groove is unbreakable.

According to the embodiment, when the second surface of the thin film part that is opposite to the first surface is pushed toward the interior of the discharge passage, the second groove and the third grooves are broken, the central part of the thin film part that is defined by the second groove is then turned around the first groove that serves as a hinge so that the central part is pushed into the discharge passage, the opening of the inlet end of the discharge passage is then opened, the hinge is then prevented from being folded back by the fourth groove so that the opening of the inlet end of the discharge passage is kept open.

Accordingly, the central part of the broken thin film part will not close the discharge passage when the content is discharged, so that excellent discharging performance is ensured. Further, there is no possibility that the thin film part will fall into the package since a continuous connection is maintained between the central part of the broken thin film part and the cylindrical body of the spout.

In addition, the diameter of the circular groove may be formed approximately the same as or slightly smaller than the diameter of the leading end of the cutting means, such as a punch, for cutting the thin film part. This facilitates cutting of the groove by the cutting means and allows the central part of the thin film part to be easily pushed into the discharge passage.

Further, regarding the capped spout according to one embodiment, when the capped spout is immersed in or sprayed with a chemical agent for sterilization, the outlet end of the discharge passage is closed by the cap while the inlet end of the discharge passage is also closed by the thin film part. Thus, the chemical agent is prevented from entering the discharge passage, and degradation of the taste of the content due to the chemical agent that would otherwise remain is effectively impeded. In particular, the embodiment provides good washability and removability of the chemical agent after the sterilization process that uses a chemical agent is conducted because each groove of the thin film part is formed on the first surface of the thin film part that faces the interior of the cylindrical body that is closed by the cap and the thin film part.

EMBODIMENT FOR CARRYING OUT THE INVENTION

Figure 1:
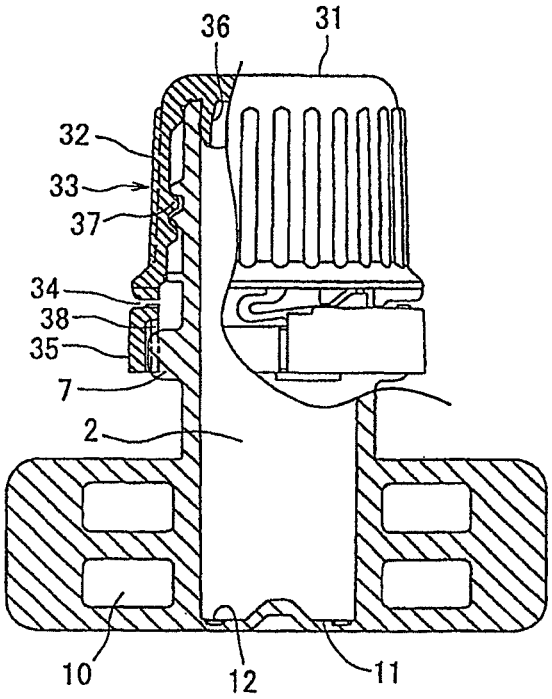
FIG. 1 is a sectional side view (partial side view) of an exemplary capped spout of the present invention.

The present invention will be described with reference to the accompanying drawings.

As shown in FIGS. 1 to 6, the capped spout of the present invention is formed of spout 1 and cap 30 that is removably applied to spout 1 in a thread engagement. Spout 1 and cap 30 are molded separately.

Spout 1 has cylindrical body 3 and welding part 4 that is located at the lower part of cylindrical body 3 and that secures spout 1 to a bag-shaped package (not shown), such as a pouch. Hole 2 (hereinafter called discharge passage 2) that forms a discharge passage for a liquid or a colloidal fluid extends through cylindrical body 3.

Thread part 5, annular rib 6 and a plurality of projections 7 are formed on the outer surface of the upper part of cylindrical body 3. Thread part 5 is provided to thread-engage with cap 30, described below. Projections 7 are provided to break the tamper evident band of cap 30.

Annular rib 6 closely abuts against the bottom surface of a stepped portion, which is formed at the lower part of the inner surface of the main body of cap 30, when cap 30 is attached to the cylindrical body 3 in order to close the opening of the outlet end of discharge path 2, and thereby prevents a chemical agent from entering cap 30.

Welding part 4 includes projecting part 8 and welding surface 9 that extends downward from the circumference of projecting part 8. The bag-shaped package is welded to welding surface 9. In the example illustrated in the drawings, welding part 4 includes a plurality of through-holes 10 that extend in the direction perpendicular to the drawing in order to reduce the amount of resin used for molding the welding part.

Cap 30 includes cap main body 33, which is formed of ceiling part 31 and skirt part 32 that extends downwards from ceiling part 31, and tamper evident band 35 that is integrally formed at the lower end of skirt part 32 via breakable weakened part 34.

Inner ring 36 that closely abuts against the upper inner surface of cylindrical body 3 of the spout is formed on the inner surface of ceiling part 31 of cap main body 33. Thread part 37 for engaging with thread part 5 of cylindrical body 3 of the spout is formed on the inner surface of skirt part 32.

Further, a plurality of projections 7 is formed on the outer surface of cylindrical body 3 of the spout, and a plurality of ratchet pieces 38 that engage with projections 7 are formed on the inner surface of tamper evident band 35. Accordingly, when cap 30 is turned open, projections 7 and ratchet pieces 38 engage with each other in the circumferential direction of the cap so that tamper evident band 35 stays with spout 1, instead of following the turning of cap main body 30. Thus, it is possible to indicate that the package has already been opened.

In addition, projections 39 are formed at the top of tamper evident band 35 in the example shown in the drawings. Projections 39 can abut against the lower end of skirt portion 32 of cap main body 33 in the axial and circumferential directions at the time of capping (when the cap is closed). The purpose of these projections is to prevent breakable weakened part 34, formed between cap main body 33 and tamper evident band 35, from being broken at the time of capping. Specifically, at the time of capping, projections 39 are engaged in recesses 41, which are formed between projections 40 formed at the bottom of skirt portion 32 of cap main body 33.

Figure 7:
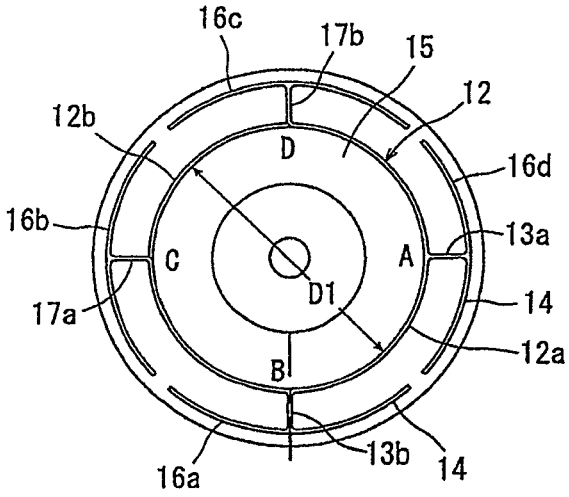
FIG. 7 is a view showing the shapes of the grooves formed in the thin film part of the spout shown in FIG. 5.

In addition to the basic configuration described above, the capped spout of the present invention further includes thin film part 11 that closes the opening that is formed at the inlet end of discharge passage 2. Thin film part 11 has circular groove 12 that is formed concentric with thin film part 11 when viewed from the top. In circular groove 12, arc AB forms unbreakable first groove 12*a*, and arc BCDA, which is the part other than arc AB, forms breakable second groove 12*b*, as shown in FIG. 7. Note that the grooves have different depths in order to form breakable and unbreakable grooves.

Third linear grooves 13*a*, 13*b* are also formed on the top surface of thin film part 11. Third grooves 13*a*, 13*b* extend outwardly from both ends A, B of first groove 12*a*, respectively, in the radial direction of cylindrical body 3. Each of third grooves 13*a*, 13*b* is formed to be breakable. Arc-shaped fourth groove 14 is formed on the top surface of this thin film part 11. Fourth groove 14 is located radially outwardly of first groove 12*a* between third grooves 13*a*, 13*b*. The fourth groove 14 is formed to be unbreakable.

In the present invention, the opening of spout 1 on the side of welding part 4 is closed by thin film part 11. The inner side of each of the spout 1 and cap 30 is previously sterilized by electron beam radiation. Cap 30 is then attached to spout 1 in order to close the opening of spout 1 opposite to welding part 4. In this manner, the sterilized interior of the capped spout is kept in an aseptic condition. Further, since the interior of cylindrical body 3 of spout 1 is closed by means of cap 30 and thin film part 11, a chemical agent will not penetrate into the interior of cylindrical body 3 while the spout is sterilized with a chemical agent. Thus, problems caused by a chemical agent that remains in the spout can be prevented.

Circular grooves (first groove 12*a*, second groove 12*b*), third grooves 13*a*, 13*b* and fourth groove 14 on thin film part 11 are formed on the top surface of thin film part 11, i.e., on the surface that faces the interior of cylindrical body 3. As a result, there ceases to be any problem in which the chemical agent adheres to the grooves, which are thin parts of thin film part 11, and in which it becomes difficult to remove the chemical agent during the sterilization process that uses the chemical agent. It is therefore possible to definitely prevent the chemical agent for the spout from remaining in the spout by a simple method, such as air blowing.

In the capped spout of the present invention, central part 15 of thin film part 11, which is defined by circular grooves 12, is adapted to turned around a hinge (or a folding line) formed by unbreakable first groove 12*a* and is adapted to be pushed into discharge passage 2.

In this configuration, central part 15 is effectively prevented from being folded back to the original position because unbreakable first groove 12*a* forms an arc and both ends of arc AB are located closer to the side, where central part 15 is folded back, than to the middle point of the arc.

Further, arc-shaped fourth groove 14 is located outward of arc-shaped first groove 12*a* with regard to the radial direction of cylindrical body 3 so that double arcs are formed. Accordingly, the hinge tends to remain folded. In other words, the hinge is less likely to be folded back. As a result, the condition in which central part 15 of thin film part 11 is pushed into discharge passage 2 can be stably maintained, and communication between discharge passage 2 and the interior of the bag-shaped package can be ensured.

In this illustrated example, in addition to the grooves described above, except in the area of fourth groove 14, arc-shaped fifth grooves 16*a*, 16*b*, 16*c* and 16*d* are formed on the top surface of thin film part 11 along a circle that includes fourth groove. Each fifth groove is formed to be unbreakable. Further, sixth linear grooves 17*a*, 17*b* are also formed at positions opposite to linear third grooves 13*a*, 13*b*, respectively. Each sixth groove on the top surface of thin film part 11 is formed to be breakable. Grooves 13*b*, 17*a*, 17*b* and 13*a* extend from fifth grooves 16*a*, 16*b*, 16*c* and 16*d*, respectively, to second groove 12*b* in the radial direction of cylindrical body 3.

Figure 8:
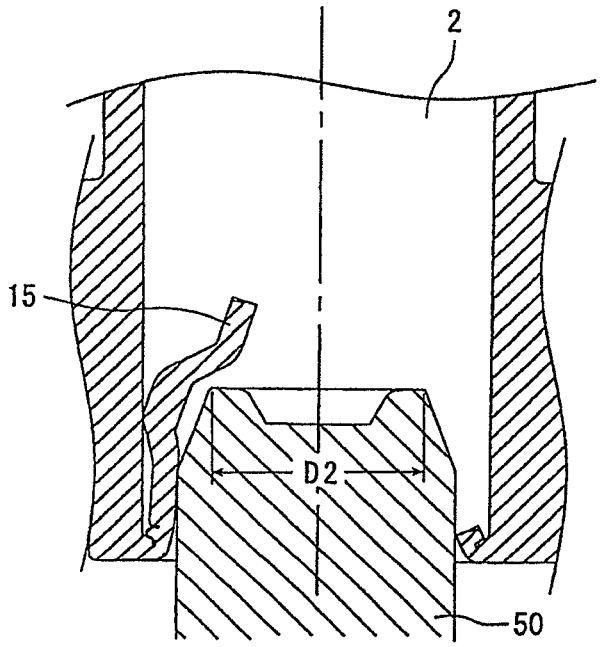
FIG. 8 is a view illustrating how to cut the breakable grooves in the thin film part.

In this configuration, when thin film part 11 is pushed from below by cutting means 50 that is used to cut grooves (see FIG. 8), such as a punch, second groove 12*b* is cut and third grooves 13*a*, 13*b*, sixth grooves 17*a*, 17*b* are then broken as cutting means 50 penetrates discharge passage 2. That is, cutting means 50 can be smoothly pushed into discharge passage 2.

Moreover, arc-shaped fifth grooves 16*a*, 16*b*, 16*c* and 16*d* are preferably formed on the circle that includes arc-shaped fourth groove 14. This allows each outer circumferential part of thin film part 11, separated by grooves 13*a*, 13*b*, 17*a*, 17*b*, to be easily folded into discharge passage 2 as the cutting means penetrates discharge passage 2. As a result, a discharge opening having an adequate size can be ensured and smooth flow of the content can be realized.

Figure 5:
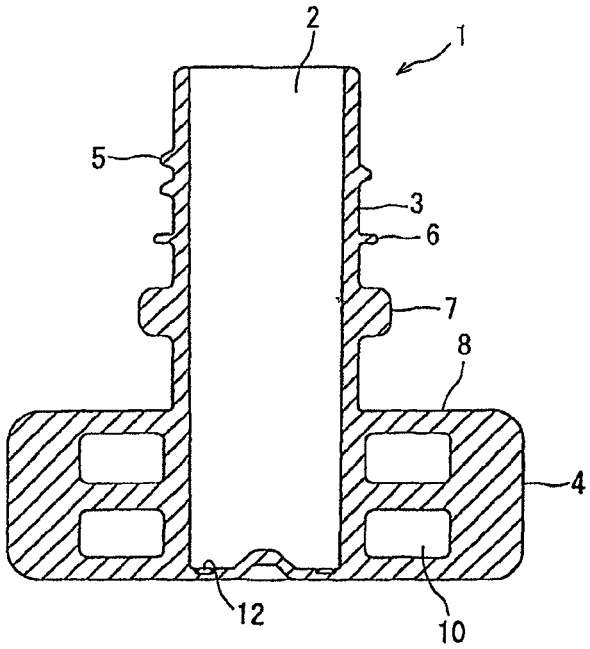
FIG. 5 is a sectional view of the spout main body of the capped spout shown in FIG. 1.
Figure 6:
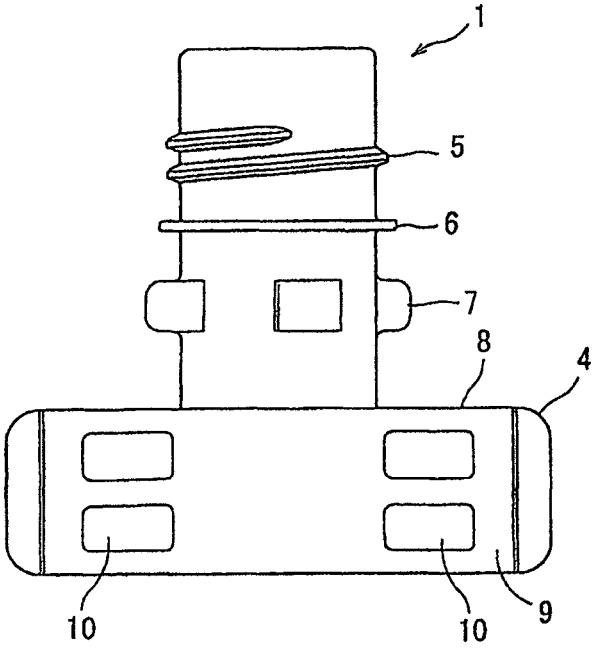
FIG. 6 is a side view of the capped spout shown in FIG. 5.

As shown in FIGS. 1 and 5, thin film part 11 of the capped spout of the present invention is preferably convex with the center protruding upward so that thin film part 11 forms a slope that extends from the vertex located at the center to the periphery. This allows the leading end of the cutting means to be easily positioned at the center of thin film part 11 and allows grooves 13*a*, 13*b*, 17*a*, 17*b* to be uniformly broken from arc BCDA that forms second groove 12*b*.

Further, in the present invention, diameter D1 (see FIG. 7) of circular groove 12 is preferably the same as or slightly smaller than diameter D2 (see FIG. 8) of the leading end of cutting means 50 that is used to cut thin film part 11, such as a punch. This allows cutting means 50 to cut the grooves easily and allows central part 15 of thin film part 11 to be pushed into discharge passage 2 easily.

Further, in the present invention, the interior of the capped spout of the present embodiment has been previously sterilized by electron beam radiation. The capped spout is then immersed in or sprayed with a chemical agent. Similarly, the bag-shaped package, to which the capped spout is welded, is sterilized by a chemical agent. The chemical agent that adheres to the capped spout and the bag-shaped package is then removed by air blowing, and thin film part 11 is cut and cut thin film part 11 is pushed into the cylindrical body 3. These processes effectively prevent the chemical agent from remaining not only in the interior of the spout but also on the outer surface of the spout. Finally, the sterilized bag-shaped package is filled with the content and one or both sides of welding part 4 of the sterilized capped spout are welded to the mouth of the bag-shaped package.

Thread parts 5, 37 are located in the closed space formed by cap 30 and annular rib 6 when cap 30 is attached to cylindrical body 3 in order to close the opening of the outlet end of discharge passage 2. Accordingly, even if the capped spout is immersed in or sprayed with a chemical agent, there will not be any occurrence of a problem in which the chemical agent adheres to fine protrusions and recesses, such as the threaded parts, and in which removal of the chemical agent becomes difficult.

The capped spout of the present invention is not limited to the above example and may be modified in various ways.

For example, the center angle that is formed by both ends of first groove 12*a* with regard to the center of thin film part 11 is 90 degrees in the example shown in FIG. 7. However, the center angle is not limited to that angle in the present invention as long as the part functions as a hinge. The center angle is preferably within a range from 45 degrees to 120 degrees.

Any configuration, depth and so on may be selected for first groove 12*a* (arc AB) as long as the groove maintains flexibility as a hinge and will not be broken. However, the first groove is preferably formed to be a continuous groove in order to ensure flexibility as a hinge, as shown in FIG. 7. On the other hand, fourth groove 14, located radially outward of first groove 12*a*, does not have to be formed to be a continuous groove and may be separated into several grooves (two grooves in FIG. 7).

Regarding the linear grooves that extend in the radial directions of cylindrical body 3, four grooves 13*a*, 13*b*, 17*a*, 17*b* are uniformly formed in the example shown in FIG. 7, but the present invention is not limited to the example. It is preferable that the grooves are uniformly formed only in the region of arc-shaped groove (12*b*) selected from circular grooves (12*a*, 12*b*). The number of the grooves is preferably, but not limited to, three to eight.

In FIG. 7, except in the area of arc-shaped fourth groove 14, a plurality of fifth grooves 16*a*, 16*b*, 16*c* and 16*d* is formed along a circle that includes arc-shaped fourth groove 14. However, the present invention is not limited to that. Grooves 16*a*, 16*b*, 16*c* and 16*d* may be formed as an annular groove that is located on a circle, the circle being concentric with a circle that includes fourth groove 14.

In the example shown in FIGS. 1, 5 etc., thin film part 11 forms a slope that extends from a vertex located at the center to the periphery. However, the present invention is not limited to the example as long as the leading end of cutting means 50 (FIG. 8) can be precisely guided to the center of the bottom surface of thin film part 11. The shape of the recess formed in the center of the bottom surface of thin film part 11 may be modified in various ways as long as the chemical agent will not remain on the top surface of thin film part 11. For example, the inner surface of the recess may be formed of a flat surface or a curved surface.

Figure 2:
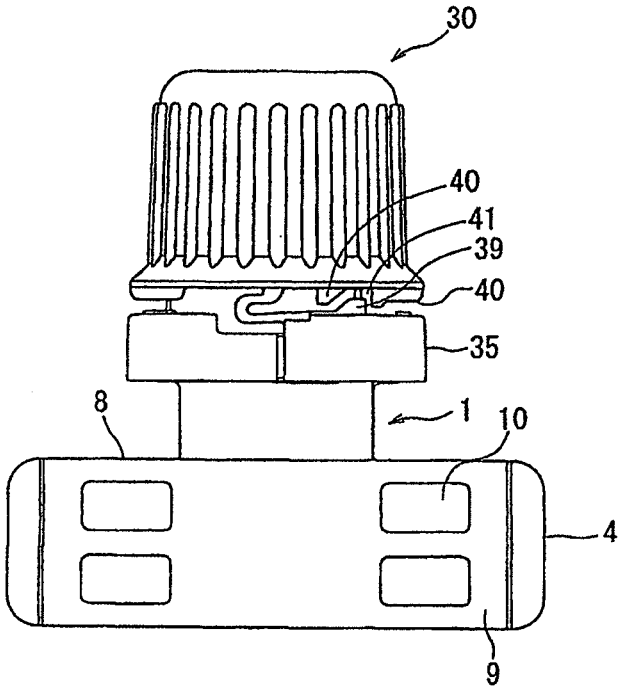
FIG. 2 is a side view of the capped spout shown in FIG. 1.
Figure 3:
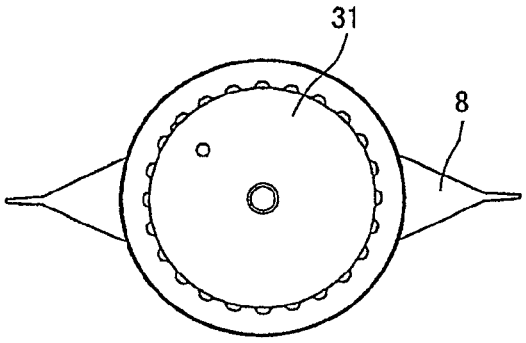
FIG. 3 is a top view of the capped spout shown in FIG. 1.
Figure 4:
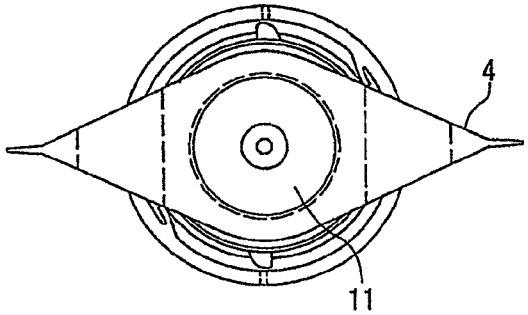
FIG. 4 is a bottom view of the capped spout shown in FIG. 2.

Tamper evident band 35 is formed in the example shown in FIG. 2. However, it is not necessary that the tamper evident band be provided. Instead, the cap portion may be covered with a shrink film.

Further, while it is preferable that welding part 4 be provided with recesses in order to reduce the amount of resin used for molding and to limit sink marks, voids and the like during molding, it is necessary to prevent chemical agent from remaining in welding part 4. For this reason, it is preferable that the recesses be formed as through-holes 10, as shown in FIGS. 1 and 2, or that the inner surfaces of the recesses be formed as curved surfaces that do not have fine edges.

The capped spout of the present invention may be manufactured by forming the spout and the cap separately according to known processes, such as injection molding and compression molding, and then by assembling them. In order to mold them, thermoplastic resin used for molding conventional spouts, such as polyethylene and polypropylene, may be used.

According to the capped spout of the present invention, the chemical agent can be completely removed by simple means, such as air blowing, when the capped spout is sterilized with a chemical agent. Therefore, the present invention can be preferably used for a bag-shaped package for aseptic processing.

The capped spout of the present invention has been described by way of certain embodiments. However, the present invention is not limited to these embodiments. It should be noted that various modifications may be made for carrying out the invention without departing from the technical spirit of the invention.

The present application is based on, and claims priority from, J.P. Application No. 2012-226876, filed on Oct. 12, 2012, the disclosure of which is hereby incorporated by reference herein in its entirety.

What is claimed is:

1. A capped spout comprising a spout and a cap that engages with the spout, the spout comprising:

a cylindrical body having an interior that serves as a discharge passage for discharging liquid content in a bag-shaped package, wherein the cap is attached to the cylindrical body in order to close an opening of an outlet end of the discharge passage; and a welding part that is formed outside the cylindrical body and that is welded to an opening of the package, wherein further comprising a thin film part that is formed inside the cylindrical body in order to close an opening of an inlet end of the discharge passage;

the thin film part has a circular groove that is concentric with the thin film part, the circular groove is formed on a first surface of the thin film part, the first surface faces an interior of the cylindrical body, the interior being closed by the cap and the thin film part;

the circular groove is formed of an arc-shaped first groove and an arc-shaped second groove that is longer than the first groove, third linear grooves extend on the first surface outwardly from each of both ends of the second groove in a radial direction of the cylindrical body, and the first groove is unbreakable and the second and third grooves are breakable; and, an arc-shaped fourth groove is further formed on the first surface, the fourth groove is located radially outward of the first groove between a pair of the third grooves, the fourth groove being unbreakable wherein, except in an area of the fourth groove, the first surface has a plurality of arc-shaped fifth grooves formed along a circle, the circle including the fourth groove and the fifth grooves being unbreakable; and the first surface further has at least one sixth groove that extend from the respective fifth grooves to the second groove in a radial direction of the cylindrical body, wherein the sixth groove are breakable, wherein the thin film is separated into a first part and a plurality of second parts, wherein the first part includes a central portion inside the circular groove and an outer circumferential part that faces the fourth groove, and the first part can be folded along the first groove, and wherein the second parts are outer circumferential parts that face the fifth grooves, and the second parts are circumferentially divided by the third and sixth grooves and can be folded along the fifth groove.

2. The capped spout according to claim 1, wherein when a second surface of the thin film part that is opposite to the first surface is pushed toward the interior of the discharge passage, the second groove and the third grooves are broken, a central part of the thin film part that is defined by the second groove is then turned around the first groove that serves as a hinge so that the central part is pushed into the discharge passage, the opening of the inlet end of the discharge passage is then opened, the hinge is then prevented from being folded back by the fourth groove so that the opening of the inlet end of the discharge passage is kept open.

3. The capped spout according to claim 1, wherein a center angle that is formed by both ends of the first groove with regard to a center of the thin film part is 45 degree to 120 degree.

4. The capped spout according to claim 1, wherein the cylindrical body has an annular rib formed on an outer surface thereof, the annular rib is in close contact with an inner surface of the cap in order to prevent liquid from entering the cap when the cap is attached to the cylindrical body so that the opening of the outlet end of the discharge passage is closed.

5. The capped spout according to claim 4, wherein an outer surface of the cylindrical body and an inner surface of the cap have thread parts that engage with each other, respectively, the thread parts are located in a closed space formed by the cap and the annular rib when the cap is attached to the cylindrical body so that the opening of the outlet end of the discharge passage is closed.

* * * * *